United States Patent [19]

Glanvall

[11] 4,099,896

[45] Jul. 11, 1978

[54] ROTARY COMPRESSOR

[75] Inventor: Rune Valdemar Glanvall, Norrkoping, Sweden

[73] Assignee: Stal Refrigeration AB, Norrkoping, Sweden

[21] Appl. No.: 770,354

[22] Filed: Feb. 22, 1977

[30] Foreign Application Priority Data

Feb. 26, 1976 [SE] Sweden ..... 76024777

[51] Int. Cl.[2] ..... F04C 29/08

[52] U.S. Cl. ..... 418/184

[58] Field of Search ..... 418/183, 184, 185, 186, 418/188, 223, 224, 268; 417/204

[56] References Cited

U.S. PATENT DOCUMENTS

| | | | |
|---|---|---|---|
| 824,647 | 6/1906 | Hamann | 418/184 X |
| 1,635,522 | 7/1927 | Wilson | 418/185 X |
| 3,778,199 | 12/1973 | Meacham | 418/183 X |

*Primary Examiner*—Carlton R. Croyle
*Assistant Examiner*—Leonard E. Smith
*Attorney, Agent, or Firm*—Cyrus S. Hapgood

[57] ABSTRACT

A cylindrical rotor journalled in a housing has an even number of vanes slidable in slots in the rotor and adapted to sealingly engage the inside wall surface of the housing to form working chambers between the rotor, said wall surface and the vanes, the rotor being provided with recesses adapted to cooperate with outlet parts in the end walls of the housing to form outlet passages for compressed gas. Piston means are located radially inside each of these recesses and connected to a diametrically opposed vane, each piston means being movable into the corresponding recess by said vane so as to fill up the recess and thereby force the gas therein out through the corresponding outlet port.

3 Claims, 4 Drawing Figures

ROTARY COMPRESSOR

The present invention relates to a rotary compressor of the vane type comprising a housing provided with inlet ports for a gas to be compressed, a cylindrical rotor rotatably journalled in the housing, and an even number of vanes slidable in slots in the rotor and adapted to sealingly engage the inside wall surface of the housing in order to form working chambers between said rotor, said wall surface and said vanes, the rotor being provided with recesses adapted to cooperate with outlet ports in the end walls of the housing to form outlet passages for compressed gas.

The recesses of the rotor constitute a portion of the so-called dead space of the compressor, which means the portion of a working chamber remaining after the exhaust phase. The amount of compressed gas present in this dead space is not discharged through the outlet port but will instead expand during the subsequent suction phase. The energy developed during the expansion cannot usually be utilized but will more or less be lost, which affects the efficiency of the compressor. The dead space also contributes to reducing the built-in volume ratio, which means the ratio between the largest volume of a working chamber after completion of the suction phase, and the smallest volume of the working chamber prior to the exhaustion. It is therefore desirable to minimize the volume of the dead space as far as possible without causing other negative effects on the efficiency, such as an increased pressure drop during the exhaustion of the compressed gas.

A compressor made in accordance with the present invention has a considerably improved efficiency due to eliminating the disadvantageous effect of the dead space substantially completely, and at the same time other negative effects are avoided. This has been achieved by a rotary compressor of the aforementioned kind which, according to the invention, is generally characterized by piston means provided radially inside each of the recesses in the rotor and connected to the diametrically opposite vanes, each of said piston means being movable into the respective recess in order to fill up the same successively and thereby force the gas in the recess out through the corresponding outlet port.

Figure 1:
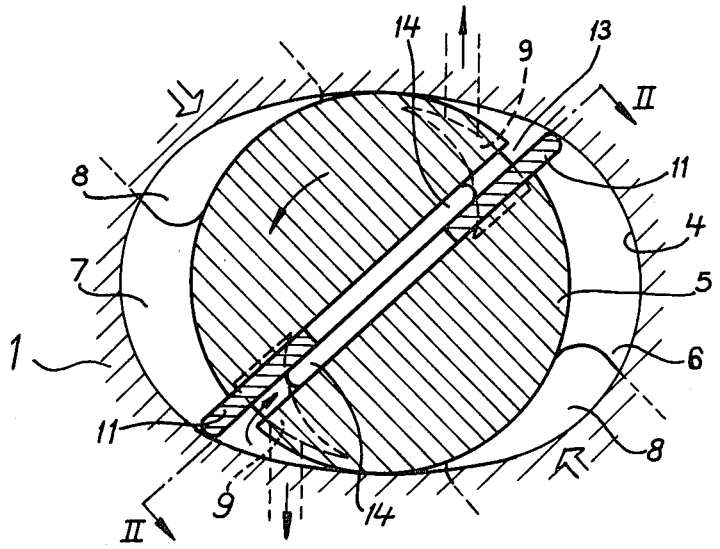
Figure 2:
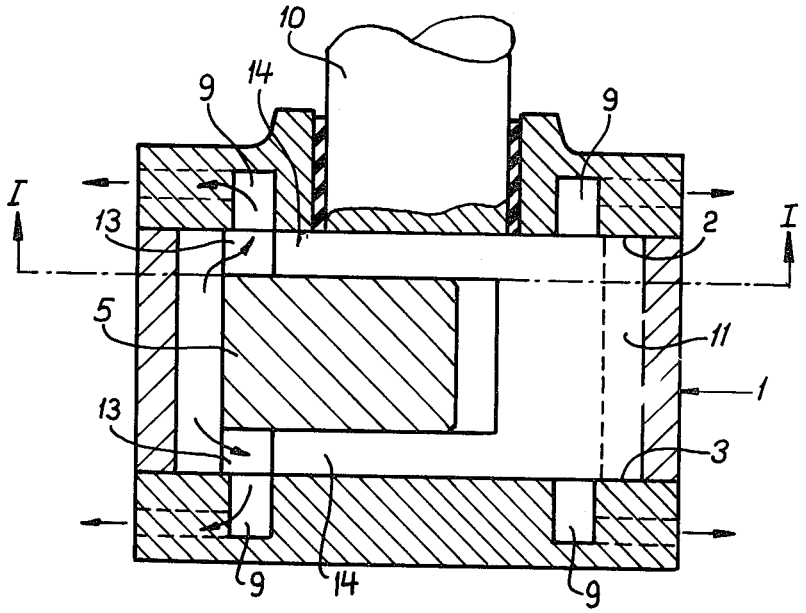
Figure 3:
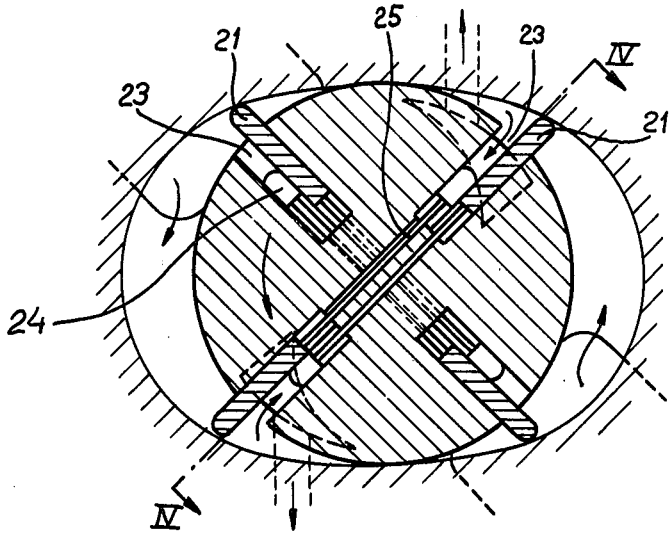
Figure 4:
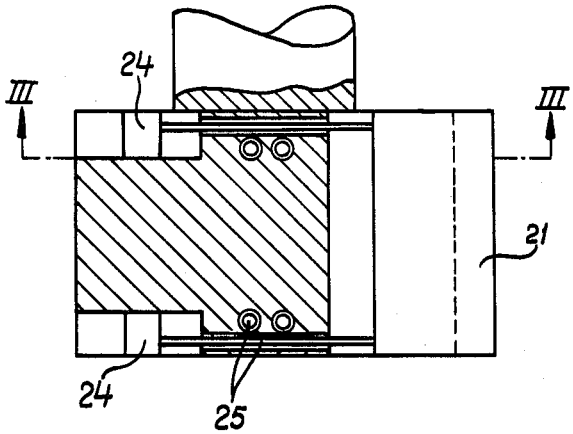

The invention will be described more in detail below with reference to the accompanying drawings, in which FIGS. 1 and 2 are cross-sectional and longitudinal sectional views, respectively, of a first embodiment; and FIGS. 3 and 4 are corresponding views of a second embodiment of the compressor according to the invention.

The vane compressor shown in FIG. 1 comprises a housing 1, the interior of which is confined by two plane, parallel end walls 2 and 3 and a cylindrical circumferential wall 4 having an approximately elliptical cross-sectional outline. A circular cylindrical rotor 5 is journalled in the housing 1 and divides the interior thereof into two identical working chambers 6 and 7. Each working chamber has inlet ports 8 and outlet ports 9 provided in the end walls 2 and 3.

The rotor 5 is connected to a driving shaft 10 and is provided with vanes 11 which are slidable in radial slots in the rotor and sealingly engaged with the walls of the working chambers 6 and 7. In addition, the rotor has recesses 13 at both ends which are adapted to cooperate with the outlet ports 9 in the end walls to form outlet passages for compressed gas. Radially inside each of the recesses 13 is a piston means 14 which is connected to the diametrically opposite vane and is thus slidable together therewith. In this embodiment, the piston means are made integral with the respective vanes.

During rotation of the rotor 5 in the direction of the arrow in FIG. 1, the gas sucked in through the inlets 8 into the working chamber in front of each vane is compressed until the recesses 13 of the rotor reach the outlet ports 9, and then the gas begins to flow out through these ports. During the discharge period in which the recesses 13 pass along the outlet ports, the vanes are slid radially inwardly in the rotor, whereby the piston means 14 will be displaced into the recesses. Since the cross-section of the piston means corresponds to that of the recesses, the latter will be filled up completely so that the gas therein will be forced out through the outlet ports 9. The disadvantage of the dead spaces formed by the recesses of the rotor in conventionally designed vane compressors is thus eliminated substantially completely.

As appears from FIG. 1, the outlet ports 9 are formed so that the width thereof decreases in the direction of rotation of the rotor, the side of the ports facing the center having a contour which corresponds to the path of movement of the piston means 14. In spite of the decreasing width of the outlet ports, the discharge flow velocity and consequently also the pressure drop across the outlet are still kept at an acceptable level, since the amount of gas discharged per unit of time decreases correspondingly.

In the embodiments according to FIGS. 3 and 4, the design of the compressor housing is the same as that described above, but the rotor is provided with four vanes 21. The compressor housing has been omitted in FIG. 4. The rotor is provided at each of its ends with recesses 23, and in each of these recesses is a displaceable piston means 24 which is connected by means of a rod 25 to the diametrically opposite vane. In principle, the operation of this embodiment of the compressor is the same as that described with reference to FIGS. 1 and 2. Thus, during the exhaust phase the amount of gas present in the recesses 23 is displaced by the piston means 24 and forced out through the outlet ports in the end walls of the compressor housing.

I claim:

1. A rotary compressor of the vane type which comprises a housing having inlet ports for a gas to be compressed, the housing including end walls having outlet ports, a cylindrical rotor journalled in the housing for rotation on an axis and provided with slots, an even number of vanes slidable in said slots and adapted to sealingly engage the inside wall surface of the housing to form working chambers between said rotor, said wall surface and said vanes, the rotor having recesses adapted to cooperate with said outlet ports to form outlet passages for compressed gas, and piston means located radially inside each of said recesses in the rotor and connected to a diametrically opposed vane, each piston means being movable into the corresponding recess to fill up the same and thereby force the gas in the recess out through the corresponding outlet port.

2. The rotary compressor of claim 1, in which each piston means is integral with the diametrically opposed vane.

3. The rotary compressor of claim 1, in which the width of each said outlet port decreases in the direction of rotation of the rotor.

* * * * *